US010077605B2

(12) United States Patent
Puzz et al.

(10) Patent No.: US 10,077,605 B2
(45) Date of Patent: Sep. 18, 2018

(54) COMPONENTS AND MOTORS FOR DOWNHOLE TOOLS AND METHODS OF APPLYING HARDFACING TO SURFACES THEREOF

(71) Applicant: Baker Hughes Incorporated, Houston, TX (US)

(72) Inventors: Travis E. Puzz, Houston, TX (US); James L. Overstreet, Tomball, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 576 days.

(21) Appl. No.: 14/724,564

(22) Filed: May 28, 2015

(65) Prior Publication Data

US 2015/0259983 A1 Sep. 17, 2015

Related U.S. Application Data

(62) Division of application No. 13/189,197, filed on Jul. 22, 2011, now Pat. No. 9,045,943.

(Continued)

(51) Int. Cl.
*E21B 4/02* (2006.01)
*F03C 2/08* (2006.01)

(Continued)

(52) U.S. Cl.
CPC ..... *E21B 4/02* (2013.01); *F03C 2/08* (2013.01); *F04C 2/1075* (2013.01);

(Continued)

(58) Field of Classification Search
CPC ..... E21B 4/02
See application file for complete search history.

(56) References Cited

U.S. PATENT DOCUMENTS 3,916,506 A 11/1975 Wolf
4,228,214 A * 10/1980 Steigelman ..... B23K 35/0244 156/244.22

(Continued)

OTHER PUBLICATIONS

International Preliminary Report on Patentability for International Application No. PCT/US2011/045061 dated Jan. 23, 2013, 5 pages.

(Continued)

*Primary Examiner* — Robert Edward Fuller
(74) *Attorney, Agent, or Firm* — TraskBritt

(57) ABSTRACT

A component for a downhole tool includes a rotor and a hardfacing precursor. The hardfacing precursor includes a polymeric material, hard particles, and a metal. A hydraulic drilling motor includes a stator, a rotor, and a sintered hardfacing material on an outer surface of the rotor or an inner surface of the stator. Methods of applying hardfacing to surfaces include forming a paste of hard particles, metal matrix particles, a polymeric material, and a solvent. The solvent is removed from the paste to form a sheet, which is applied to a surface and heated. A component for a downhole tool includes a first hardfacing material, a second hardfacing material over the first hardfacing material and defining a plurality of pores, and a metal disposed within at least some of the pores. The metal has a melting point lower than a melting point of the second hardfacing material.

19 Claims, 5 Drawing Sheets

Related U.S. Application Data

(60) Provisional application No. 61/367,116, filed on Jul. 23, 2010.

(51) Int. Cl.
*F04C 2/107* (2006.01)
*F04C 13/00* (2006.01)

(52) U.S. Cl.
CPC ..... *F04C 13/008* (2013.01); *F04C 2230/91* (2013.01); *F04C 2270/16* (2013.01); *F05C 2225/00* (2013.01); *F05C 2251/10* (2013.01); *F05C 2253/04* (2013.01); *Y10T 156/10* (2015.01)

(56) References Cited

U.S. PATENT DOCUMENTS

| | | | |
|---|---|---|---|
| 5,395,221 | A | 3/1995 | Tucker et al. |
| 5,508,334 | A | 4/1996 | Chen |
| RE37,127 | E | 4/2001 | Schader et al. |
| 6,248,149 | B1 | 6/2001 | Massey et al. |
| 6,543,132 | B1 | 4/2003 | Krueger et al. |
| 6,944,935 | B2 | 9/2005 | Hache |
| 7,343,990 | B2 | 3/2008 | Pessier et al. |
| 7,770,672 | B2 | 8/2010 | Kembaiyan et al. |
| 2005/0247491 | A1 | 11/2005 | Mirchandani et al. |
| 2007/0107942 | A1 | 5/2007 | Overstreet et al. |
| 2008/0127475 | A1 | 6/2008 | Griffo |
| 2009/0044984 | A1 | 2/2009 | Massey et al. |
| 2009/0098002 | A1* | 4/2009 | Coulas ..... C23C 4/02 418/178 |
| 2009/0152009 | A1 | 6/2009 | Slay |
| 2009/0152013 | A1 | 6/2009 | Buske et al. |
| 2010/0038142 | A1 | 2/2010 | Snyder et al. |
| 2010/0224418 | A1 | 9/2010 | Eason et al. |
| 2010/0236834 | A1 | 9/2010 | Xia et al. |
| 2011/0073233 | A1 | 3/2011 | Eason et al. |
| 2011/0114394 | A1 | 5/2011 | Lockwood et al. |
| 2012/0018227 | A1 | 1/2012 | Puzz et al. |

OTHER PUBLICATIONS

International Search Report for International Application No. PCT/US2011/045061 dated Jan. 6, 2012, 3 pages.
International Written Opinion for International Application No. PCT/US2011/045061 dated Jan. 6, 2012, 4 pages.
Sinter. (n. d.) Retrieved Nov. 18, 2014, from http://www.merriam-webster.com/dictionary/sinter.

* cited by examiner

COMPONENTS AND MOTORS FOR DOWNHOLE TOOLS AND METHODS OF APPLYING HARDFACING TO SURFACES THEREOF

CROSS-REFERENCE TO RELATED APPLICATIONS

This application is a divisional of U.S. patent application Ser. No. 13/189,197, filed Jul. 22, 2011, now U.S. Pat. No. 9,045,943, issued Jun. 2, 2015, which claims the benefit of U.S. Provisional Patent Application Ser. No. 61/367,116, filed Jul. 23, 2010, titled "Wear-Resistant Hydraulic Drilling Motors, Earth-Boring Tools Including Such Motors, and Methods of Forming Such Motors and Tools," the disclosure of each of which is incorporated herein in its entirety by this reference.

FIELD

Embodiments of the present disclosure relate generally to wear-resistant hydraulic drilling motors, to earth-boring tools that include a wear-resistant hydraulic drilling motor, and to methods of forming and using such motors and tools. More particularly, embodiments of the present disclosure relate to such motors and tools that are relatively resistant to erosion caused by the flow of fluid through the motors and tools, and to methods of forming such erosion-resistant motors and tools.

BACKGROUND

To obtain hydrocarbons such as oil and gas from subterranean formations, wellbores are drilled into the formations by rotating a drill bit attached to an end of a drill string. A substantial portion of current drilling activity involves what is referred to in the art as "directional" drilling. Directional drilling involves drilling deviated and/or horizontal wellbores (as opposed to straight, vertical wellbores). Modern directional drilling systems generally employ a bottom hole assembly at the end of the drill string that includes a drill bit and a hydraulically actuated motor to drive rotation of the drill bit. The drill bit is coupled to a drive shaft of the motor, and drilling fluid pumped through the motor (and to the drill bit) from the surface drives rotation of the drive shaft to which the drill bit is attached. Such hydraulic motors are commonly referred to in the drilling industry as "mud motors," "drilling motors," and "Moineau motors." Such motors are referred to hereinafter as "hydraulic drilling motors."

Hydraulic drilling motors include a power section that contains a stator and a rotor disposed in the stator. The stator may include a metal housing that is lined inside with a helically contoured or lobed elastomeric material. The rotor is usually made from a suitable metal, such as steel, and has an outer lobed surface. Pressurized drilling fluid (commonly referred to as drilling "mud") is pumped into a progressive cavity formed between the rotor and the stator lobes. The force of the pressurized fluid pumped into and through the cavity causes the rotor to turn in a planetary-type motion. A suitable shaft connected to the rotor via a flexible coupling compensates for eccentric movement of the rotor. The shaft is coupled to a bearing assembly having a drive shaft (also referred to as a "drive sub"), which in turn rotates the drill bit attached thereto.

As drilling fluid flows through the progressive cavity between the rotor and the stator, the drilling fluid may erode surfaces of the rotor and/or the stator within the progressive cavity. Such erosion may be relatively more severe at locations at which the direction of fluid flow changes, since the drilling fluid may impinge on the surfaces at relatively higher angles at such locations. This erosion can eventually result in the deformation of the lobes of the rotor and/or the stator, which can adversely affect operation of the hydraulic drilling motor.

BRIEF SUMMARY

In some embodiments, the present disclosure includes a component for a downhole tool comprising a rotor configured to be rotatably disposed within a stator and a hardfacing precursor disposed over at least a portion of an outer surface of the rotor. The hardfacing precursor comprises a polymeric material, a plurality of hard particles dispersed within the polymeric material, and a metal formulated to become a matrix material.

Additional embodiments of the present disclosure include a hydraulic drilling motor for use in an earth-boring tool comprising a stator, a rotor rotatably disposed within the stator, and a sintered hardfacing material disposed on at least one of an outer surface of the rotor and an inner surface of the stator.

In additional embodiments, the present disclosure includes methods of applying hardfacing to a surface of a hydraulic drilling motor. A plurality of hard particles, a plurality of metal matrix particles, a polymeric material, and a solvent are mixed to form a paste. The solvent is removed from the paste to form an at least substantially solid sheet comprising the plurality of hard particles, the plurality of metal matrix particles, and the polymeric material. The at least substantially solid sheet is applied to at least one of an outer surface of a rotor and an inner surface of a stator and heated.

In some embodiments, the present disclosure includes a component for a downhole tool comprising a first hardfacing material disposed over a body, a second hardfacing material disposed over the first hardfacing material and defining a plurality of pores, and a metal disposed within at least some of the plurality of pores of the second hardfacing material. The metal has a melting point lower than a melting point of the second hardfacing material.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

As used herein, the term "erosion" refers to a two-body wear mechanism that occurs when solid particulate material and/or a fluid impinges on a solid surface. Erosion is distinguishable from "abrasion," which is a three-body wear mechanism that includes two surfaces of solid materials sliding past one another with solid particulate material therebetween.

As used herein, the term "fluid" comprises substances consisting solely of liquids as well as substances comprising solid particulate material suspended within a liquid, and includes conventional drilling fluid (or drilling mud), which may comprise solid particulate material such as additives, as well as formation cuttings and detritus suspended within a liquid.

As used herein, the term "hardfacing" means any material or mass of material that is applied to a surface of a separately formed body and that is more resistant to wear (abrasive wear and/or erosive wear) relative to the material of the separately formed body at the surface.

As used herein, the term "sintering" means and includes densification of particulate material involving removal of pores between the starting particles accompanied by shrinkage, coalescence, and bonding between adjacent particles. Sintering processes, as described herein, do not include thermal spraying processes or arc welding processes.

As used herein, a "sintered hardfacing material" is a hardfacing material formed by a sintering process. That is, a particulate material is applied to a surface of a body and is then heated to densify the material and bond adjacent particles.

The illustrations presented herein are not actual views of any particular rotor, stator, hydraulic drilling motor, or earth-boring tool, but are merely idealized representations that are employed to describe example embodiments of the present disclosure. Additionally, elements common between figures may retain the same numerical designation.

Figure 1A:
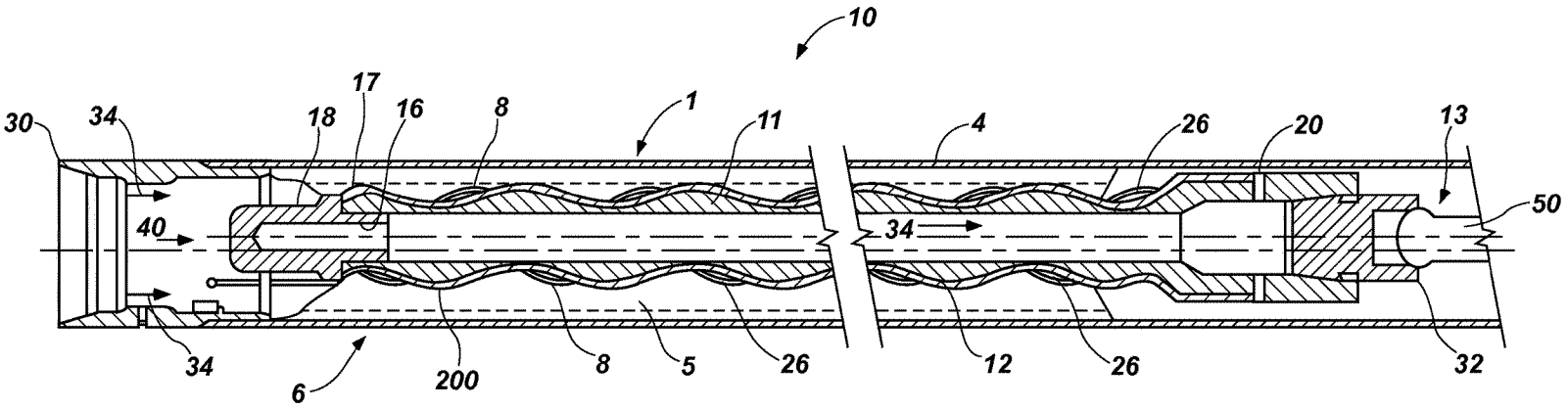
FIGS. 1A and 1B illustrate an embodiment of a hydraulic drilling motor according to the present disclosure.
Figure 1B:
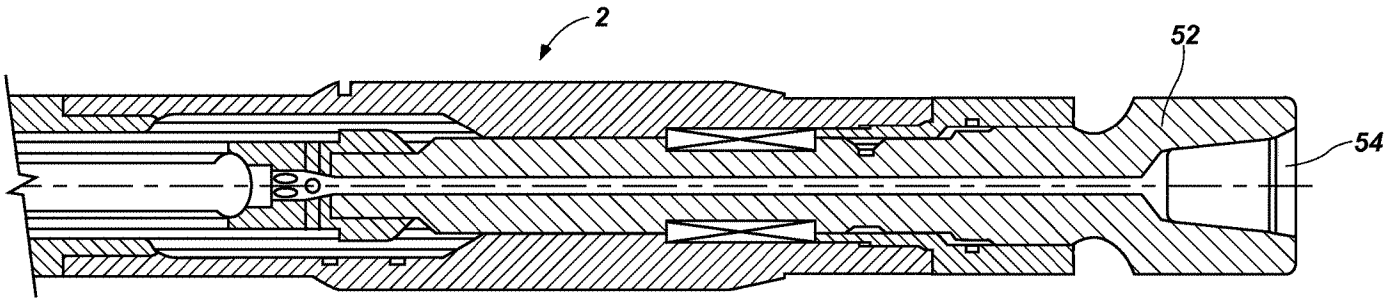

The present disclosure includes embodiments of methods of applying hardfacing to internal surfaces of a hydraulic drilling motor, such as the hydraulic drilling motor 10 shown in FIGS. 1A and 1B, to intermediate structures formed during such methods, and to hydraulic drilling motors and earth-boring tools formed using such methods.

In some embodiments, the methods involve mixing together one or more polymer materials with particles that will ultimately be used to form a hardfacing material, applying the mixture to a surface of at least one of a rotor and a stator of a hydraulic drilling motor, and heating the mixture (while it remains disposed on the at least one of the rotor and the stator) to remove the polymer material and sinter at least some of the particles previously mixed with the polymer material to form one or more layers of hardfacing material on the surface of the rotor and/or the stator.

Referring to FIGS. 1A and 1B, the hydraulic drilling motor 10 includes a power section 1 and a bearing assembly 2. The power section 1 includes an elongated metal housing 4, having an elastomeric member 5 therein that has a helically lobed inner surface 8. The elastomeric member 5 is secured inside the metal housing 4, for example, by bonding the elastomeric member 5 within the interior of the metal housing 4. The elastomeric member 5 and the metal housing 4 together form a stator 6. A rotor 11 is rotatably disposed within the stator 6. In other words, the rotor 11 is disposed within the stator 6 and configured to rotate therein responsive to the flow of drilling fluid through the hydraulic drilling motor 10. The rotor 11 includes a helically lobed outer surface 12 configured to engage with the helically lobed inner surface 8 of the stator 6. A sintered hardfacing material 200 may be formed on the outer surface 12 of the rotor 11.

The outer surface 12 of the rotor 11 and the inner surface 8 of the stator 6 may have similar, but slightly different profiles. For example, the outer surface 12 of the rotor 11 may have one fewer lobe than the inner surface 8 of the stator 6. The outer surface 12 of the rotor 11 and the inner surface 8 of the stator 6 may be configured so that seals are established directly between the rotor 11 and the stator 6 at discrete intervals along and circumferentially around the interface therebetween, resulting in the creation of fluid chambers or cavities 26 between the outer surface 12 of the rotor 11 and the inner surface 8 of the stator 6. The cavities 26 may be filled with a pressurized drilling fluid 40.

As the pressurized drilling fluid 40 flows from a top 30 to a bottom 32 of the power section 1, as shown by flow arrows 34, the pressurized drilling fluid 40 causes the rotor 11 to rotate within the stator 6. The number of lobes and the geometries of the outer surface 12 of the rotor 11 and inner surface 8 of the stator 6 may be modified to achieve desired input and output requirements and to accommodate different drilling operations. The rotor 11 may be coupled to a flexible shaft 50, and the flexible shaft 50 may be connected to a drive shaft 52 in the bearing assembly 2. As previously mentioned, a drill bit (not shown) may be attached to the drive shaft 52. For example, the drive shaft 52 may include a threaded box 54, and a drill bit may be provided with a threaded pin that may be engaged with the threaded box 54 of the drive shaft 52.

Figure 2:
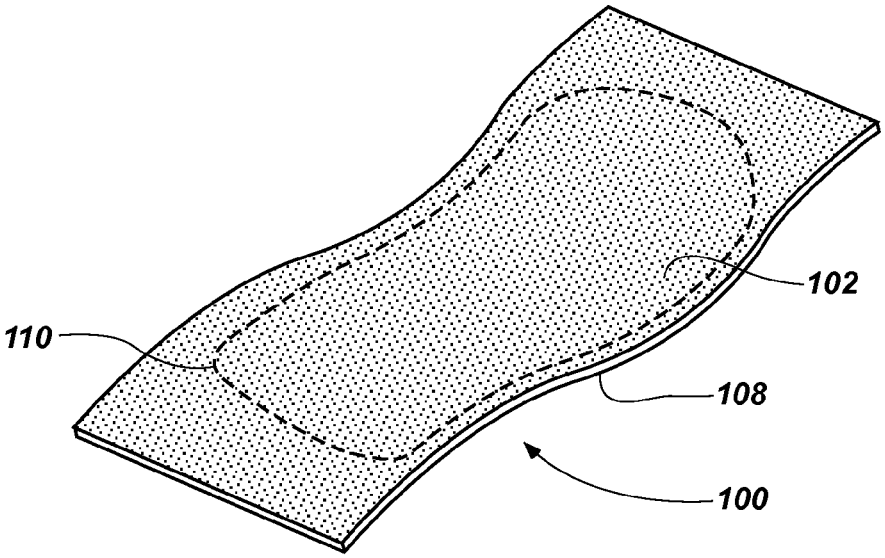
FIG. 2 is a simplified perspective view of an embodiment of a hardfacing precursor sheet that may be used to form a layer of hardfacing material on surfaces of a hydraulic drilling motor in accordance with embodiments of the disclosure.

In some embodiments, a hardfacing precursor sheet 100, as illustrated in FIG. 2, may be formed and applied to internal surfaces of the hydraulic drilling motor 10 such as, for example, to at least one of the outer surface 12 of the rotor 11 or the inner surface 8 of the stator 6 of the hydraulic drilling motor 10. Such hardfacing precursor sheets 100 are described in U.S. patent application Ser. No. 12/570,934, filed Sep. 30, 2009, titled "Method of Applying Hardfacing Sheet," and U.S. patent application Ser. No. 12/398,066, filed Mar. 4, 2009, titled "Methods of Forming Erosion Resistant Composites, Methods of Using the Same, and Earth-Boring Tools Utilizing the Same in Internal Passageways," the entire disclosures of each of which are incorporated herein by reference. The hardfacing precursor sheet 100 may be applied, for example, to the outer surface 12 of the rotor 11. In particular, the hardfacing precursor sheet 100 may be applied to regions of the outer surface 12 of the rotor 11 that are susceptible to erosion caused by the flow of drilling fluid 40 through the hydraulic drilling motor 10. For purposes of this application, regions "susceptible to erosion"

caused by the flow of drilling fluid 40 through the hydraulic drilling motor 10 may be considered as those regions of the hydraulic drilling motor 10 that would be eroded away by drilling fluid if conventional drilling fluid were to flow through the hydraulic drilling motor 10 at conventional drilling flow rates and fluid pressures for a period of time of less than about five times the average lifetime, in terms of operating hours, for the respective design or model of the hydraulic drilling motor 10. In other words, if conventional drilling fluid is caused to flow through the hydraulic drilling motor 10 at conventional flow rates and fluid pressures for a period of time that is about five times the average lifetime of the respective design or model of the hydraulic drilling motor 10, and a region of the positive displacement motor has eroded away, that region may be considered to be a region "susceptible to erosion" caused by the flow of drilling fluid through the hydraulic drilling motor 10 for purposes of this disclosure.

While the stator 6 (FIG. 1A) may comprise an elastomeric member 5 that is at least substantially comprised of an elastomeric material, in additional embodiments, the stator 6 may be formed of a metallic material, such as steel. Such metallic stators 6 are described in, for example, U.S. Pat. No. 6,543,132, issued Apr. 8, 2003, titled "Methods of Making Mud Motors," the entire disclosure of which is incorporated herein by reference. When the stator 6 is formed of a metallic material, it may be desirable to apply a sintered hardfacing material 200 over at least a portion (e.g., some or all) of the inner surface 8 of the stator 6. Accordingly, while the following embodiments are described in terms of forming a sintered hardfacing material 200 on the outer surface 12 of the rotor 11, it is understood that additional embodiments of the disclosure include using the same materials and methods to apply the sintered hardfacing material 200 to the inner surface 8 of the stator 6.

As shown in FIG. 2, a hardfacing precursor sheet 100 may comprise a generally pliable planar body. The hardfacing precursor sheet 100 may include a carrier member 102 impregnated with materials that will ultimately form the sintered hardfacing material 200. The carrier member 102 may include any conformable material, in or on which the hardfacing precursor materials (e.g., particles) can be retained and carried. In some embodiments, the carrier member 102 may comprise a polymer (e.g., a plastic material or an elastomeric material), and, if desirable, one or more additives such as a plasticizer. In some embodiments, the polymer may comprise a three-dimensional polymer network such as, for example, an epoxy. In additional embodiments, the polymer may comprise a copolymer, such as a polystyrene-ethylene and polybutylene-styrene (SEBS) block copolymer.

In some embodiments, the carrier member 102 may comprise a polymer material comprising a thermoplastic and elastomeric material. As used herein, the term "thermoplastic material" means and includes any material that exhibits a hardness value that decreases as the temperature of the material is increased from about room temperature to about one hundred degrees Celsius. (100° C.). As used herein, the term "elastic" means and includes a material that, when subjected to tensile loading, undergoes more non-permanent elongation deformation than permanent (i.e., plastic) elongation deformation prior to rupture. By way of example and not limitation, the polymer of the carrier member 102 may comprise at least one of styrene-butadiene-styrene, styrene-ethylene-butylene-styrene, styrene-divinylbenzene, styrene-isoprene-styrene, and styrene-ethylene-styrene. The thermoplastic elastomer may comprise a block copolymer material having at least one end block having a molecular weight of from about 50,000 to about 150,000 grams per mole and at least one center block having a molecular weight of from about 5,000 to about 25,000 grams per mole. Further, the block copolymer material may exhibit a glass transition temperature of from about 130° C. to about 200° C. In some embodiments, the polymer material of the carrier member 102 may comprise a polymer such as those described in U.S. Pat. No. 5,508,334, issued Apr. 16, 1996, titled "Thermoplastic Elastomer Gelatinous Compositions and Articles," the disclosure of which is incorporated herein in its entirety by this reference.

The hardfacing precursor sheet 100 may include hard particles and matrix or binder particles. The hard particles and binder particles may comprise a powder-like substance dispersed at least substantially uniformly through or over the carrier member 102. The hard particles may include a hard material such as diamond, cubic boron nitride (the foregoing two materials also being known in the art as "superhard" and "superabrasive" materials), boron carbide, aluminum nitride, and carbides, oxides, or borides of the group consisting of W, Ti, Mo, Nb, V, Hf, Zr, Si, Ta, and Cr. The matrix or binder particles may be formed of a metal or metal alloy. Examples of the matrix or binder particles include cobalt, a cobalt-based alloy, iron, an iron-based alloy, nickel, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy. The material of the matrix or binder particles may have a melting temperature of about 800° C. or greater. The matrix or binder particles may be fully dense (i.e., the density of the matrix or binder particles may not substantially increase during subsequent sintering) or less than fully dense. Less-than-fully dense matrix or binder particles may include pores or voids, as described below with respect to FIGS. 7 and 8. Fully dense matrix or binder particles may be substantially free of pores. The hardfacing precursor sheet 100 may also include an adhesive surface 108 on at least one of its sides for retaining the hardfacing precursor sheet 100 on the outer surface 12 of the rotor 11. The entire hardfacing precursor sheet 100 may be applied to the outer surface 12 of the rotor 11, or, optionally, a pattern 110 may be cut from the hardfacing precursor sheet 100 that is fashioned to match a particular portion of the outer surface 12 of the rotor 11.

Figure 3:
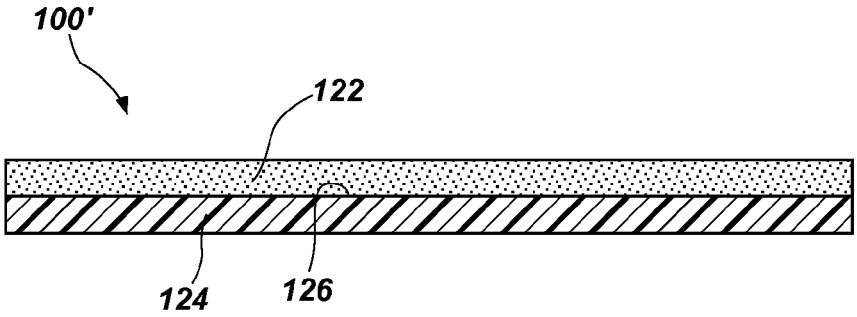
FIG. 3 is a simplified cross-sectional view of an embodiment of a multi-layer hardfacing sheet that may be used to form a layer of hardfacing material on surfaces of a hydraulic drilling motor in accordance with embodiments of the disclosure.

FIG. 3 illustrates another embodiment of a hardfacing precursor sheet 100' including at least two layers. The hardfacing precursor sheet 100' includes a first layer 122 and at least one additional second layer 124. The first layer 122 covers at least a portion of a surface 126 of the second layer 124. Each of the first layer 122 and the second layer 124 includes a carrier member 102, as shown in FIG. 2, comprising a polymer material and a plurality of particles dispersed throughout the carrier member 102. In some embodiments, each of the first layer 122 and the second layer 124 may comprise hard particles and binder particles. In additional embodiments, the particles within the first layer 122 may be at least substantially composed of hard particles and the particles within the second layer 124 may be at least substantially composed of binder particles. In additional embodiments, the particles within the first layer 122 may be at least substantially composed of binder particles, and the particles within the second layer 124 may be at least substantially composed of hard particles.

The polymer material of the carrier member 102 of the first layer 122 may have a composition identical or at least substantially similar to a composition of the polymer material of the carrier member 102 of the second layer 124. In additional embodiments, the polymer material of the carrier member 102 of the first layer 122 may have a material composition that is different from a material composition of the polymer material of the carrier member 102 of the second layer 124. One or both of the polymer material of the carrier member 102 of the first layer 122 and the polymer material of carrier member 102 of the second layer 124 may comprise a thermoplastic and elastomeric material.

In some embodiments, one or both of the first layer 122 and the second layer 124 of the multi-layer hardfacing precursor sheet 100' may comprise a sheet of at least substantially solid material. For example, the second layer 124 may comprise a sheet of at least substantially solid material. Additionally, in some embodiments, one or both of the first layer 122 and the second layer 124 of the multi-layer hardfacing precursor sheet 100' may comprise a paste. By way of example and not limitation, the second layer 124 may comprise a sheet of at least substantially solid material, and the first layer 122 may comprise a paste that is disposed on and that at least substantially covers the surface 126 of the second layer 124.

Figure 4:
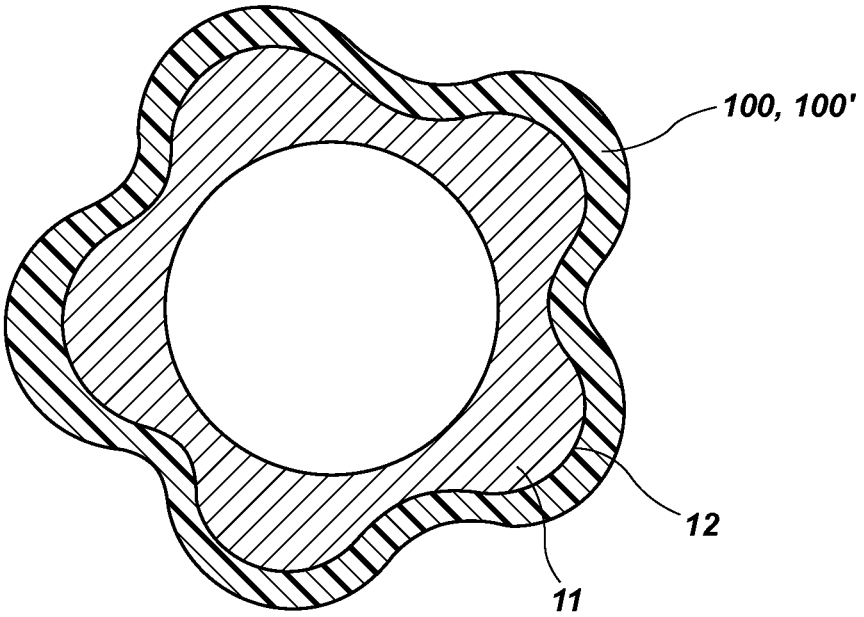
FIG. 4 is a cross-sectional view of a rotor illustrating a hardfacing precursor sheet like that shown in FIG. 3 on an outer surface of a rotor of a hydraulic drilling motor.
Figure 5:
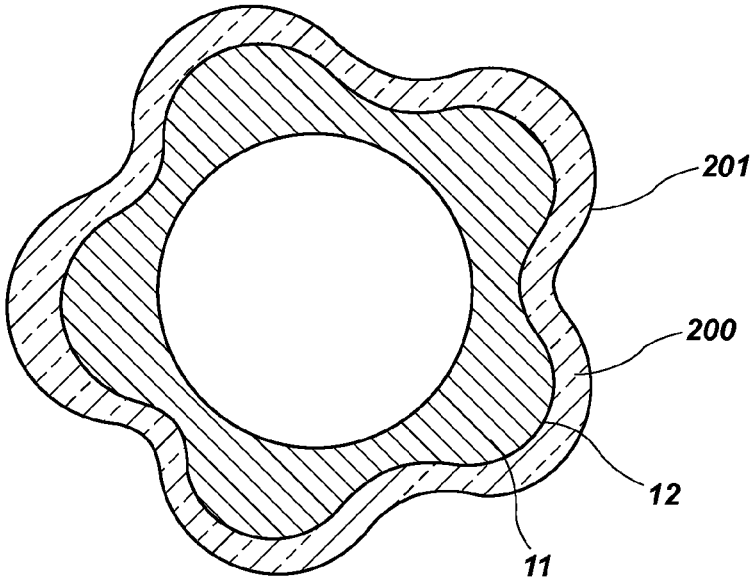
FIG. 5 is a cross-sectional view of the rotor shown in FIG. 4, illustrating a layer of hardfacing material formed from the hardfacing precursor sheet of FIG. 3.

FIG. 4 is a cross-sectional view of the hardfacing precursor sheet 100, 100' applied to the outer surface 12 of the rotor 11. FIG. 5 is a cross-sectional view of a layer of sintered hardfacing material 200 formed from the hardfacing precursor sheet 100, 100' on the outer surface 12 of the rotor 11. By way of example and not limitation, the sintered hardfacing material 200 may comprise a composite material having a relatively hard first phase distributed within a second, continuous metal- or metal-alloy matrix phase.

By way of example and not limitation, the relatively hard first phase may be formed from the hard particles, and may comprise a hard material such as diamond, boron carbide, cubic boron nitride, aluminum nitride, and carbides or borides of the group consisting of W, Ti, Mo, Nb, V, Hf, Zr, Si, Ta, and Cr. The continuous metal- or metal-alloy matrix phase may be formed from the binder particles, and may comprise cobalt, a cobalt-based alloy, iron, an iron-based alloy, nickel, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy. In some embodiments, the first phase may comprise a plurality of discrete regions or particles dispersed within the metal- or metal-alloy matrix phase.

In some embodiments, the sintered hardfacing material 200 may comprise a hardfacing composition as described in U.S. Pat. No. 6,248,149, issued Jun. 19, 2001, titled "Hardfacing Composition for Earth-Boring Bits Using Macrocrystalline Tungsten Carbide and Spherical Cast Carbide;" in U.S. Pat. No. 7,343,990, issued Mar. 18, 2008, titled "Rotary Rock Bit with Hardfacing to Reduce Cone Erosion;" or in U.S. Reissued Pat. No. RE37,127, reissued Apr. 10, 2001, titled "Hardfacing Composition for Earth-Boring Bits;" the disclosures of each of which are incorporated herein in their entirety by this reference.

In some embodiments, the hardfacing precursor sheet 100, 100' (FIGS. 2 and 3) used to form the sintered hardfacing material 200 may be formed in situ on the surface 12 of the rotor 11 (FIG. 4), while in other embodiments, the hardfacing precursor sheet 100, 100' may be separately formed and subsequently applied to the outer surface 12 of the rotor 11. Methods for forming the sintered hardfacing material 200 are described in further detail below.

Particles that will be used to form sintered hardfacing material 200 (FIG. 5) (i.e., hard particles and/or particles comprising a metal- or metal-alloy matrix material) may be mixed with one or more polymer materials and one or more solvents to form a paste or slurry.

The one or more polymer materials may comprise a thermoplastic and elastomeric polymer material. For example, at least one of styrene-butadiene-styrene, styrene-ethylene-butylene-styrene, styrene-divinylbenzene, styrene-isoprene-styrene, and styrene-ethylene-styrene may be mixed with the particles and the solvent to form the paste or slurry.

In addition to the polymer material, the slurry may comprise one or more plasticizers for selectively modifying the deformation behavior of the polymer material. The plasticizers may be or include light oils (such as paraffinic and naphthenic petroleum oils), polybutene, cyclobutene, polyethylene (e.g., polyethylene glycol), polypropene, an ester of a fatty acid, or an amide of a fatty acid.

The solvent may comprise any substance in which the polymer material can at least partially dissolve. For example, the solvent may comprise methyl ethyl ketone, alcohols, toluene, hexane, heptane, propyl acetate, trichloroethylene, or any other conventional solvent or combination thereof.

The slurry may also comprise one or more stabilizers for aiding suspension of the one or more polymer materials in the solvent. Suitable stabilizers for various combinations of polymers and solvents are known to those of ordinary skill in the art.

After forming the paste or slurry, the paste or slurry may be applied as a relatively thin layer on a surface of a substrate using, for example, a tape casting process. The solvent then may be allowed to evaporate from the paste or slurry to form a relatively solid layer of polymer material in which the hard particles and/or binder are embedded. For example, the paste or slurry may be heated on a substantially planar surface of a drying substrate after tape casting to a temperature sufficient to evaporate the solvent from the paste or slurry. The paste or slurry may be dried under a vacuum to decrease drying time and to eliminate any vapors produced during the drying process.

To form the hardfacing precursor sheet 100, 100' in situ on the outer surface 12 of the rotor 11, a slurry or paste formed by mixing hard particles and binder particles with one or more polymer materials and one or more solvents (and optionally, plasticizers, stabilizers, etc.) may be applied directly to the outer surface 12 of the rotor 11 to which sintered hardfacing material 200 (FIG. 5) is to be applied. The slurry or paste then may be dried and, optionally, polymerized. The slurry or paste may be sprayed onto the outer surface 12 of the rotor 11, the outer surface 12 of the rotor may be dipped into the slurry or paste to coat the outer surface 12 of the rotor 11, or the paste or slurry may be spread or otherwise applied onto the outer surface 12 of the rotor 11. The sintered hardfacing material 200 then may be formed by sintering the hardfacing precursor sheet 100, 100'.

To form the multi-layer hardfacing precursor sheet 100' shown in FIG. 3, a slurry may be formed by mixing binder particles with one or more polymer materials and one or more solvents, and the slurry may be tape cast and dried to form the second layer 124 of the multi-layer hardfacing precursor sheet 100. After forming the second layer 124, a paste may be formed by mixing hard particles with one or more polymer materials and one or more solvents, and the paste may be applied to a major surface of the second layer 124, such that the major surface of the second layer 124 is at least substantially coated with the paste used to form the first layer 122 of the multi-layer hardfacing precursor sheet 100'.

After forming the hardfacing precursor sheet 100, 100', the hardfacing precursor sheet 100, 100' may be applied to the outer surface 12 of the rotor 11 to which sintered hardfacing material 200 is to be applied (if the hardfacing precursor sheet 100, 100' was not formed in situ on the outer surface 12 of the rotor 11). An adhesive may be provided between the hardfacing precursor sheet 100 and the outer surface 12 of the rotor 11 to promote adhesion between the hardfacing material 100, 100' and the outer surface 12 of the rotor 11. The hardfacing precursor sheet 100, 100' may be cut or otherwise formed to have a desired shape complementary to a portion of the outer surface 12 of the rotor 11 to which it is to be applied.

The rotor 11, together with the hardfacing precursor sheet 100, 100' on the outer surface 12 thereof, then may be heated in a furnace to form a sintered hardfacing material 200 on the outer surface 12 of the rotor 11. Alternatively, the hardfacing precursor sheet 100, 100' on the outer surface 12 of the rotor 11 may be heated using a localized heating source, such as electrical arc welding, a torch, or a laser. The temperature of the hardfacing precursor sheet 100, 100' may be kept below the melting temperature of the binder particles. Upon heating the hardfacing precursor sheet 100, 100' to temperatures of from about 150° C. to about 500° C., organic materials within carrier member 102 of the hardfacing precursor sheet 100, 100' may volatilize and/or decompose, leaving behind the inorganic components of hardfacing precursor sheet 100, 100' on the outer surface 12 of the rotor 11. For example, the hardfacing precursor sheet 100, 100' may be heated at a rate of about 2° C. per minute to a temperature of about 450° C. to cause organic materials (including polymer materials) within the hardfacing precursor sheet 100, 100' to volatilize and/or decompose.

After heating the hardfacing precursor sheet 100, 100' to volatilize and/or decompose organic materials therein, the remaining inorganic materials of the hardfacing precursor sheet 100, 100' may be further heated to a relatively higher sintering temperature to sinter the inorganic components and form a sintered hardfacing material 200 therefrom. For example, the remaining inorganic materials of the hardfacing precursor sheet 100, 100' may be further heated at a rate of about 15° C. per minute to a sintering temperature of about 1150° C. The sintering temperature may be proximate a melting temperature of the metal- or metal-alloy-matrix material of the binder particles in the hardfacing precursor sheet 100, 100'. For example, the sintering temperature may be slightly below, slightly above, or equal to a melting temperature of the metal- or metal-alloy-matrix material. In some embodiments, the sintering temperature may be within from about 0.5 times to about 0.8 times the melting temperature, in absolute terms (e.g., on the Kelvin scale), of the metal- or metal-alloy-matrix material.

The volatilization and/or decomposition process, as well as the sintering process, may be carried out under vacuum (i.e., in a vacuum furnace), in an inert atmosphere (e.g., in an atmosphere having nitrogen, argon, helium, and/or another at least substantially inert gas), or in a reducing atmosphere (e.g., hydrogen).

During the sintering process, at least the binder particles comprising a metal or metal alloy may consolidate to form an at least substantially continuous metal- or metal-alloy-matrix phase in which a discontinuous hard phase formed from the hard particles is distributed. In other words, during sintering, the hard particles may become embedded within a layer of metal- or metal-alloy-matrix material formed from the particles comprising the metal- or metal-alloy-matrix material. If the hardfacing precursor sheet 100' comprises a multi-layer hardfacing precursor sheet 100', during the sintering process, the metal- or metal-alloy-matrix material within the second layer 124 of the hardfacing 100' may be wicked into the first layer 122 between the hard particles therein. As the rotor 11 cools, the metal- or metal-alloy-matrix material bonds to the outer surface 12 of the rotor 11 and holds the hard particles in place on the outer surface 12 of the rotor 11.

The metal- or metal-alloy-matrix material may form crystalline structures having smaller dimensions than crystalline structures in which matrix material is substantially melted, such as in thermal spraying and welding techniques. The grain size (i.e., an average linear dimension of a single crystalline structure of the metal or metal alloy) of a matrix material formed by sintering may be similar to the grain size in sintered tungsten carbide. For example, the grain size of a matrix material may be from about 0.1 microns to about 100 microns, or from about 0.5 microns to about 50 microns. Furthermore, because the matrix material may remain substantially solid during sintering, the boundary between the sintered hardfacing material 200 and the outer surface 12 of the rotor 11 may better defined than the boundary between hardfacing formed by conventional techniques and the underlying bodies.

In some embodiments, the hardfacing precursor sheet 100, 100' may have an average thickness and composition such that, upon sintering, the resulting layer of sintered hardfacing material 200 formed on the outer surface 12 of the rotor 11 has an average thickness of from about 0.125 millimeter (0.005 inch) to about 12 millimeters (0.5 inch). The hardfacing precursor sheet 100, 100' may be of uniform or nonuniform thickness, as dictated by design requirements.

Because of the complex geometry of the rotor 11, conventional hardfacing techniques, such as metal plating, flame spray, and arc welding, when used to apply a hardfacing material to a rotor 11, may require finish machining and/or other processing to cause the hardfacing material to have a selected geometry, such as a geometry that conforms to the shape of the rotor 11. However, in some embodiments, the sintered hardfacing material 200 formed from the hardfacing precursor sheet 100, 100' may not require any additional finish machining or processing once formed on the rotor 11. By using the hardfacing precursor sheet 100, 100', as described herein, the hardfacing precursor sheet 100, 100' may be shaped to conform to the outer surface 12 of the rotor 11 before sintering, and, therefore, the sintered hardfacing material 200 may not require additional machining once formed. Furthermore, the sintered hardfacing material 200 formed on the outer surface 12 of the rotor 11 may have an at least substantially uniform thickness over the outer surface 12 of the rotor 11.

As previously discussed in relation to FIG. 3, the hardfacing precursor sheet 100' may include at least two layers of differing compositions. In some embodiments, multiple hardfacing sheets 100, 100' having different compositions may be applied to the outer surface 12 of the rotor 11. For example, each hardfacing precursor sheet 100, 100' may be sintered to form a layer of the sintered hardfacing material 200 before applying another hardfacing precursor sheet 100, 100'. Alternatively, multiple hardfacing precursor sheets 100, 100' may be formed on the outer surface 12 of the rotor 11 and then the multiple the hardfacing precursor sheets 100, 100' may be sintered concurrently. By applying more than one hardfacing precursor sheet 100, 100', the sintered hardfacing material 200 on the outer surface 12 of the rotor 11 may be customized for specific drilling conditions. For example, the sintered hardfacing material 200 may be tailored to achieve desired mechanical properties such as wear resistance, hardness, corrosion resistance, and bonding strength of the sintered hardfacing material 200 to outer surface 12 of the rotor 11. In some embodiments, the sintered hardfacing material 200 may be tailored so that the concentration of hard particles within the matrix material changes across the thickness of the sintered hardfacing material 200. For example, the concentration of hard particles in the sintered hardfacing material 200 may increase from the inner surface of the sintered hardfacing material 200 adjacent the rotor 11 toward an outer surface 201 of the sintered hardfacing material 200. In some embodiments, the sintered hardfacing material 200 may comprise three layers. The first layer may comprise a bonding material used to bond the sintered hardfacing material 200 to the outer surface 12 of the rotor 11. The bonding material may comprise, for example, a low temperature braze alloy such as a NiCrBSiFe alloy, an austenitic nickel-chromium-based super alloy, such as INCONEL® alloy 718 INCONEL® alloy 625, each available from Special Metal Corporation, of Huntington, W. Va., or a NiAl material. The bonding material may bond the sintered hardfacing material 200 to the outer surface 12 of the rotor 11 via an exothermic reaction. The bonding material may have a thickness of about 0.25 millimeter (0.010 inch). A second layer comprising about 70% by weight matrix material and about 30% by weight hard particles may be formed over the bonding material. The hard particles of the second layer may comprise tungsten carbide and the metal matrix material may comprise, for example, nickel or a nickel alloy. The second layer may have a thickness of about 12 millimeters (0.5 inch). A third layer comprising about 30% by weight matrix material and about 70% by weight hard particles may be formed over the second layer and may form the outer surface 201 of the sintered hardfacing material 200. The hard particles of the third layer may comprise cobalt-cemented tungsten carbide material, and the matrix material may comprise nickel or a nickel alloy. The third layer may have a thickness of about 2.5 millimeters (0.10 inch). By including more hard particles in the third layer than the second layer, the third layer may be harder, more corrosion resistant, and/or more wear resistant than the second layer.

Figure 6:
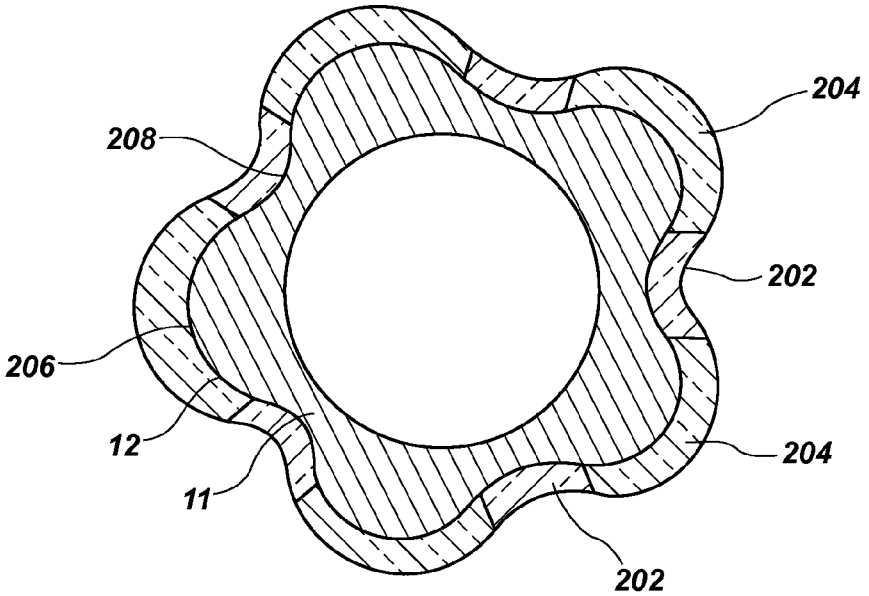
FIG. 6 is a cross-sectional view of a rotor illustrating two hardfacing materials on an outer surface of the rotor formed from hardfacing precursor sheets.

In additional embodiments, because of the control provided by using the hardfacing sheets 100, 100', the geometry of the sintered hardfacing material 200 may be tailored to correspond to the geometry of the outer surface 12 of the rotor 11. More specifically, the hardfacing sheets 100, 100' may be cut and placed directly onto the desired location on the surface 12 of the rotor 11. For example, as shown in FIG. 6, the outer surface 12 of the rotor 11 may be covered with a first sintered hardfacing material 202 and a second sintered hardfacing material 204. The second sintered hardfacing material 204 may be formed on the lobes 206 of the rotor 11, and the first sintered hardfacing material 202 may be formed on the area 208 between the lobes 206 of the rotor 11. Because the lobes 206 of the rotor 11 may be more prone to corrosion than the area between the lobes 206, the second sintered hardfacing material 204 may be thicker and/or more corrosion resistant than the first sintered hardfacing material 202. For example, the second sintered hardfacing material 204 may comprise tungsten carbide hard particles dispersed throughout a metal-matrix material comprising a NiAlMn bronze material, and the first sintered hardfacing material 202 may comprise tungsten carbide hard particles dispersed throughout a cobalt metal-matrix material.

In additional embodiments, the location of the sintered hardfacing material 200 along the length of the rotor 11 may also be tailored to correspond with the geometry of the rotor 11 by using the hardfacing sheets 100, 100'. For example, high erosion areas of the rotor 11 may be covered with a greater thickness of sintered hardfacing material 200 or a more erosion-resistant sintered hardfacing material 200 than other portions of the rotor 11. For example, the first tangential portion of the first lobe 17 (FIG. 1A) of the rotor 11 may be relatively more susceptible to erosion, corrosion, and/or other damage. As such, the first tangential portion of the first lobe 17 may be covered with a thicker sintered hardfacing material 200 or a more erosion-resistant sintered hardfacing material 200 than other parts of the rotor 11.

Figure 7:
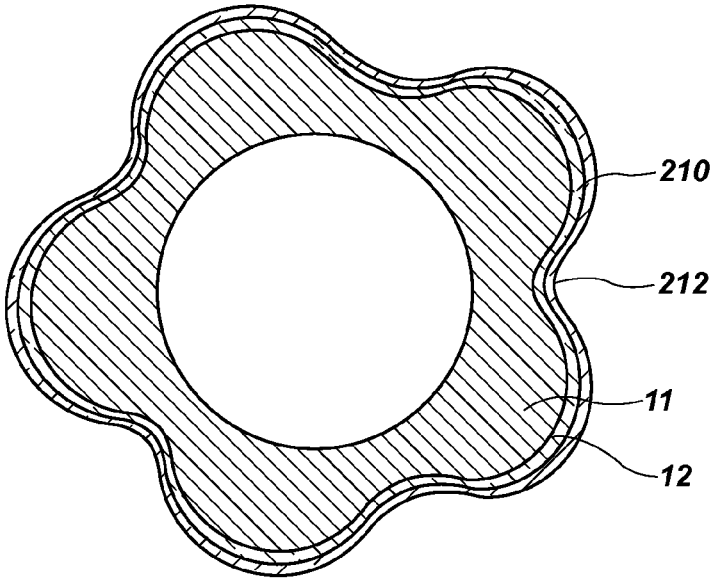
FIG. 7 is a cross-sectional view of a rotor illustrating a porous hardfacing material on an outer surface of a rotor formed from a hardfacing precursor sheet.
Figure 8:
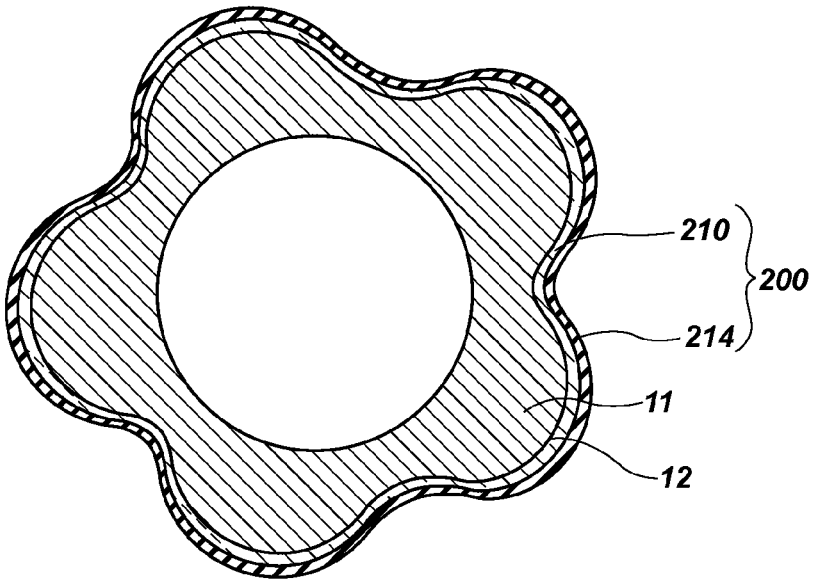
FIG. 8 is a cross-sectional view of the rotor of FIG. 7 having a low-melting-point metal in pores of the porous hardfacing material.

FIGS. 7 and 8 illustrate another embodiment of the sintered hardfacing material 200 formed on the outer surface 12 of the rotor 11. As shown in FIG. 7, a first layer 210 of hardfacing material may be formed on the outer surface 12 of the rotor 11. The first layer 210 may comprise metal or metal alloy such as a dense Ni alloy. A second, porous layer 212 of hardfacing material may be formed over the first layer 210 of hardfacing material. The second, porous layer 212 of hardfacing material may comprise a metal or metal alloy having pores therein. The second, porous layer 212 may have at least about 10% porosity by volume. Both the first layer 210 and the second layer 212 may be formed from hardfacing sheets 100, 100'. In some embodiments, the second layer 212 may be formed with the desired porosity by forming the hardfacing precursor sheet 100, 100' with particles of an organic material dispersed therethrough. When the hardfacing precursor sheet 100, 100' is heated to form the second layer 212, the particles of organic material may volatilize and/or decompose to form pores within the second layer 212.

Once the second layer 212 of hardfacing material is formed, a low-melting-point metal may be deposited over the second layer 212. The low-melting-point metal may then be heated so that the low-melting-point metal infiltrates the pores to form a metal-infused second layer 214, as shown in FIG. 8. The first layer 210 and the metal-infused second layer 214 may together be the sintered hardfacing material 200. The low-melting-point metal may have a melting point of about 350° C. or lower. For example, the low-melting-point metal may comprise at least one of indium (which has a melting point of about 156° C.), bismuth (which has a melting point of about 271° C.), and alloys thereof. In some embodiments, the low-melting-point metal may have a melting point lower than a melting point of a phase of material of the second layer 212 into which it is infused. For example, the low-melting-point metal may have a melting point lower than the lowest melting point of any phase of material of the second layer 212. In other words, the hardfacing material of the second layer 212 may include two or more phases of material, and each phase may have different melting points. Upon heating the metal-infused second layer 214, the first material to melt may be the low-melting-point metal disposed within pores.

High-temperature drilling operations, such as geothermal wells, may reach temperatures exceeding the melting point of the low-melting-point metal. For example, high temperature drilling operations may exceed temperatures of about 150° C. During these high temperature drilling operations, the low-melting-point metal may melt and exude out of the metal-infused second layer 214. The low-melting-point metal may then serve as a lubricant between the rotor 11 and the stator 6 and may provide a liquid metal seal between the lobes of the rotor 11 and the stator 6.

Although the present disclosure has been described in terms of hydraulic drilling motors, it is understood that similar devices may operate as hydraulic pumps by driving rotation of the drive shaft to pump hydraulic fluid through the body of the pump. Thus, embodiments of the disclosure may also apply to such hydraulic pumps, and to systems and devices including such hydraulic pumps.

Additional non-limiting example embodiments of the disclosure are described below.

Embodiment 1

A component for a downhole tool comprising a rotor configured to be rotatably disposed within a stator and a hardfacing precursor disposed over at least a portion of an outer surface of the rotor. The hardfacing precursor comprises a polymeric material, a plurality of hard particles dispersed within the polymeric material, and a metal formulated to become a matrix material.

Embodiment 2

The component of Embodiment 1, further comprising a stator having another hardfacing precursor disposed over at least a portion of an inner surface thereof, the another hardfacing precursor comprising a polymeric material, a plurality of hard particles dispersed within the polymeric material, and a metal formulated to become a matrix material.

Embodiment 3

The component of Embodiment 1 or Embodiment 2, wherein the metal comprises a plurality of metal matrix particles dispersed within the polymeric material, the plurality of metal matrix particles having a melting temperature higher than about 350° C.

Embodiment 4

The component of any of Embodiments 1 through 3, wherein the hardfacing precursor further comprises a first layer comprising a bonding material, a second layer comprising a first weight fraction of hard particles, and a third layer comprising a second weight fraction of hard particles. The second weight fraction of hard particles is greater than the first weight fraction of hard particles.

Embodiment 5

The component of any of Embodiments 1 through 4, wherein the rotor comprises at least two lobes having a first hardfacing precursor formulated to form a first hardfacing material upon sintering and an area between the at least two lobes having a second hardfacing precursor formulated to form a second hardfacing material upon sintering. The first hardfacing material has at least one mechanical property different from a mechanical property of the second hardfacing material. The at least one mechanical property is selected from the group consisting of wear resistance, hardness, corrosion resistance, bonding strength, and combinations thereof.

Embodiment 6

The component of any of Embodiments 1 through 5, wherein the polymeric material comprises a material selected from the group consisting of styrene-butadiene-styrene, styrene-ethylene-butylene-styrene, styrene-divinylbenzene, styrene-isoprene-styrene, and styrene-ethylene-styrene.

Embodiment 7

A hydraulic drilling motor for use in an earth-boring tool comprising a stator, a rotor rotatably disposed within the stator, and a sintered hardfacing material disposed on at least one of an outer surface of the rotor and an inner surface of the stator.

Embodiment 8

The hydraulic drilling motor of Embodiment 7, wherein the sintered hardfacing material comprises a hardfacing material having a plurality of pores, and further comprising a metal having a melting temperature less than about 350° C. disposed within at least some pores of the plurality of pores.

Embodiment 9

The hydraulic drilling motor of Embodiment 7 or Embodiment 8, wherein the sintered hardfacing material comprises a material selected from the group consisting of diamond, boron carbide, cubic boron nitride, aluminum nitride, carbides, oxides, and borides.

Embodiment 10

The hydraulic drilling motor of any of Embodiments 7 through 9, wherein the sintered hardfacing material comprises a metal matrix material having a melting temperature of about 800° C. or greater.

Embodiment 11

The hydraulic drilling motor of any of Embodiments 7 through 10, wherein the sintered hardfacing material comprises a metal- or metal-alloy-matrix material having an average grain size of from about 0.5 microns to about 50 microns Embodiment 12

The hydraulic drilling motor of any of Embodiments 7 through 11, wherein the sintered hardfacing material disposed on the at least one of an outer surface of the rotor and an inner surface of the stator comprises a first hardfacing material disposed on at least two lobes on the rotor and a second hardfacing material disposed on an area between the at least two lobes on the rotor.

Embodiment 13

The hydraulic drilling motor of Embodiment 12, wherein the first hardfacing material exhibits an improved property in comparison with the second hardfacing material, the property selected from the group consisting of wear resistance, hardness, corrosion resistance, bonding strength with a material of the rotor or stator, and combinations thereof.

Embodiment 14

The hydraulic drilling motor of any of Embodiments 7 through 11, wherein the sintered hardfacing material comprises a fully dense hardfacing material.

Embodiment 15

A method of applying hardfacing to a surface of a hydraulic drilling motor comprising mixing a plurality of hard particles, a plurality of metal matrix particles, a polymeric material, and a solvent to foam a paste; removing the solvent from the paste to form an at least substantially solid sheet comprising the plurality of hard particles, the plurality of metal matrix particles, and the polymeric material; applying the at least substantially solid sheet to at least one of an outer surface of a rotor and an inner surface of a stator; and heating the at least substantially solid sheet.

Embodiment 16

The method of Embodiment 15, further comprising sintering at least the plurality of metal matrix particles.

Embodiment 17

The method of Embodiment 15 or Embodiment 16, wherein heating the at least substantially solid sheet comprises heating the at least substantially solid sheet to a first temperature to remove the polymer and heating the at least substantially solid sheet to a second temperature higher than the first temperature to sinter the at least substantially solid sheet.

Embodiment 18

The method of any of Embodiments 15 through 17, wherein heating the at least substantially solid sheet to a first temperature comprises forming a plurality of pores within the at least substantially solid sheet and filling at least some of the plurality of pores with a metal having a melting point of about 350° C. or less.

Embodiment 19

The method of any of Embodiments 15 through 18, further comprising applying the paste over a surface of a substrate and removing the at least substantially solid sheet from the surface of the substrate.

Embodiment 20

The method of any of Embodiments 15, 16, 17, or 19, wherein applying the at least substantially solid sheet to at least one of an outer surface of a rotor and an inner surface of a stator comprises applying a substantially solid sheet having a fully dense hardfacing material.

Embodiment 21

A component for a downhole tool comprising a first hardfacing material disposed over a body, a second hardfacing material disposed over the first hardfacing material and defining a plurality of pores, and a metal disposed within at least some of the plurality of pores of the second hardfacing material. The metal has a melting point lower than a melting point of the second hardfacing material.

Embodiment 22

The component of Embodiment 21, wherein the body is at least one of a rotor and a stator.

Embodiment 23

The component of Embodiment 21 or Embodiment 22, wherein the metal has a melting point of about 350° C. or lower.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various bit profiles as well as cutting element types and configurations.

What is claimed is:

1. An apparatus for downhole service, comprising:
- a rotor configured to be rotatably disposed within a stator; and
- a hardfacing precursor disposed over at least a portion of an outer surface of the rotor, the hardfacing precursor comprising:
  - a polymeric material;
  - a plurality of hard particles dispersed within the polymeric material; and
  - a metal formulated to become a matrix material;
- wherein the hardfacing precursor comprises:
  - a first hardfacing precursor on at least two adjacent lobes of the rotor; and
  - a second hardfacing precursor between the at least two adjacent lobes of the rotor, the second hardfacing precursor having a composition different from the first hardfacing precursor.

2. The apparatus of claim 1, further comprising a stator having another hardfacing precursor disposed over at least a portion of an inner surface thereof, the another hardfacing precursor comprising a polymeric material, a plurality of hard particles dispersed within the polymeric material, and a metal formulated to become a matrix material.

3. The apparatus of claim 1, wherein the metal comprises a plurality of metal matrix particles dispersed within the polymeric material, the plurality of metal matrix particles having a melting temperature higher than about 350° C.

4. The apparatus of claim 1, wherein the hardfacing precursor further comprises:
- a first layer comprising a bonding material;
- a second layer comprising a first weight fraction of hard particles; and
- a third layer comprising a second weight fraction of hard particles, the second weight fraction of hard particles being greater than the first weight fraction of hard particles.

5. The apparatus of claim 1, wherein
- the first hardfacing precursor is formulated to form a first hardfacing material upon sintering;

the second hardfacing precursor is formulated to form a second hardfacing material upon sintering; and the first hardfacing material has at least one mechanical property different from a mechanical property of the second hardfacing material, the at least one mechanical property selected from the group consisting of wear resistance, hardness, corrosion resistance, bonding strength, and combinations thereof.

6. The apparatus of claim 1, wherein the polymeric material comprises a material selected from the group consisting of styrene-butadiene-styrene, styrene-ethylene-butylene-styrene, styrene-divinylbenzene, styrene-isoprene-styrene, and styrene-ethylene-styrene.

7. The apparatus of claim 1, wherein the first hardfacing precursor has a first composition, the first hardfacing precursor comprising:

a first polymeric material;

a first plurality of hard particles dispersed within the first polymeric material; and a first metal formulated to become a first matrix material; and the second hardfacing precursor has a second composition different from the first composition, the second hardfacing precursor comprising:

a second polymeric material;

a second plurality of hard particles dispersed within the second polymeric material; and a second metal formulated to become a second matrix material.

8. The apparatus of claim 1, wherein the hardfacing precursor comprises a carrier member, the carrier member comprising the polymeric material, and wherein the carrier member is impregnated with the plurality of hard particles and the metal.

9. The apparatus of claim 1, wherein the plurality of hard particles comprises at least one material selected from the group consisting of diamond, boron carbide, cubic boron nitride, aluminum nitride, carbides, oxides, and borides.

10. The apparatus of claim 1, wherein the metal exhibits a melting temperature of at least about 800° C.

11. The apparatus of claim 1, wherein the metal comprises at least one material selected from the group consisting of cobalt, cobalt-based alloys, iron, iron-based alloys, nickel, nickel-based alloys, cobalt- and nickel-based alloys, iron- and nickel-based alloys, iron- and cobalt-based alloys, aluminum-based alloys, copper-based alloys, magnesium-based alloys, and titanium-based alloys.

12. The apparatus of claim 1, wherein the metal comprises a plurality of fully dense metal particles.

13. A method of applying hardfacing to a surface of a hydraulic drilling motor component, the method comprising:

dispersing a first plurality of hard particles and a first plurality of metal particles within a first polymeric material to form a first hardfacing precursor, wherein the first plurality of metal particles is formulated to become a first matrix material;

dispersing a second plurality of hard particles and a second plurality of metal particles within a second polymeric material to form a second hardfacing precursor, wherein the second plurality of metal particles is formulated to become a second matrix material, and wherein the second hardfacing precursor has a composition different from the first hardfacing precursor;

applying the first hardfacing precursor over at least a portion of an outer surface of at least two adjacent lobes of a rotor, the rotor configured to be rotatably disposed within a stator; and applying the second hardfacing precursor over at least a portion of an outer surface of an area between the two adjacent lobes of the rotor.

14. The method of claim 13, further comprising heating the first hardfacing precursor and the second hardfacing precursor to form a sintered hardfacing material on the outer surface of the rotor, the sintered hardfacing material comprising a composite material having a relatively hard first phase distributed within a second, continuous matrix phase, the second phase comprising a metal or a metal alloy.

15. The method of claim 13, wherein dispersing a first plurality of hard particles and a first plurality of metal particles within a first polymeric material to form a first hardfacing precursor comprises forming a hardfacing precursor sheet in situ on the outer surface of the rotor.

16. The method of claim 13, wherein dispersing a first plurality of hard particles and a first plurality of metal particles within a first polymeric material to form a first hardfacing precursor comprises forming a multi-layer hardfacing precursor sheet.

17. The method of claim 13, wherein applying the first hardfacing precursor and the second hardfacing precursor over an outer surface of a rotor comprises applying an adhesive between the outer surface of the rotor and each of the first hardfacing precursor and the second hardfacing precursor.

18. The method of claim 13, wherein the hard particles in the first plurality of hard particles are the same as the hard particles in the second plurality of hard particles, the metal particles in the first plurality of metal particles are the same as the metal particles in the second plurality of metal particles, and the first polymeric material is the same material as the second polymeric material.

19. An apparatus for downhole service, comprising:

a rotor configured to be rotatably disposed within a stator; and a first hardfacing precursor disposed over at least a portion of an outer surface of at least two adjacent lobes of the rotor; and a second hardfacing precursor disposed over at least a portion of the outer surface of the rotor between the at least two adjacent lobes;

wherein the second hardfacing precursor has at least one mechanical property different from the first hardfacing precursor.

* * * * *